US009945593B2

(12) United States Patent
Koch

(10) Patent No.: US 9,945,593 B2
(45) Date of Patent: Apr. 17, 2018

(54) HEAT EXCHANGER FOR PHASE-CHANGING REFRIGERANT, WITH HORIZONTAL DISTRIBUTING AND COLLECTING TUBE

(71) Applicant: Klaus Koch, Luenen (DE)

(72) Inventor: Klaus Koch, Luenen (DE)

(73) Assignee: THERMOFIN GMBH, Heinsdorfergrund/Reichenbach (DE)

( * ) Notice: Subject to any disclaimer, the term of this patent is extended or adjusted under 35 U.S.C. 154(b) by 657 days.

(21) Appl. No.: 13/687,191

(22) Filed: Nov. 28, 2012

(65) Prior Publication Data

US 2013/0327503 A1 Dec. 12, 2013

Related U.S. Application Data

(63) Continuation of application No. PCT/EP2011/058421, filed on May 24, 2011.

(30) Foreign Application Priority Data

Jun. 4, 2010 (EP) ..... 10164993

(51) Int. Cl.

| | |
|---|---|
| ***F25B 43/02*** | (2006.01) |
| ***F25B 39/00*** | (2006.01) |
| ***F28B 1/06*** | (2006.01) |
| ***F28B 9/02*** | (2006.01) |
| ***F28B 9/08*** | (2006.01) |
| ***F28F 1/00*** | (2006.01) |

(Continued)

(52) U.S. Cl.

CPC ..... *F25B 43/02* (2013.01); *F25B 39/00* (2013.01); *F28B 1/06* (2013.01); *F28B 9/02* (2013.01);

(Continued)

(58) Field of Classification Search

CPC ..... F25B 39/00; F25B 39/02; F25B 39/028; F25B 43/02; F25B 43/006; F25B 2400/02;

(Continued)

(56) References Cited

U.S. PATENT DOCUMENTS 1,794,110 A * 2/1931 Gay ..... F25B 39/02 62/471
2,003,543 A * 6/1935 Jordan ..... 62/83

(Continued)

FOREIGN PATENT DOCUMENTS

DE 10111384 A1 9/2002
EP 1 046 875 A2 10/2000

(Continued)

*Primary Examiner* — Jianying Atkisson
*Assistant Examiner* — Jose O Class-Quinones
(74) *Attorney, Agent, or Firm* — Von Rohrscheidt Patents

(57) ABSTRACT

An exchanger for a phase changing refrigerant including a horizontal distributor tube, a horizontal collector tube, and at least one refrigerant carrying heat exchanger tube connected therebetween. A refrigerant gas inlet into the at least one heat exchanger tube is arranged in an upper portion of a cross section of the horizontal distributor tube. A refrigerant outlet from the at least one heat exchanger tube is arranged in an upper portion of a cross section of the horizontal collector tube for condenser operation of the multi channel heat exchanger so that oil separation is provided in a lower portion of the cross section of the horizontal distributor tube and liquid refrigerant separation is provided in a lower portion of the cross section of the horizontal collector tube.

10 Claims, 2 Drawing Sheets

(51) Int. Cl.

| | |
|---|---|
| *F25B 43/00* | (2006.01) |
| *F25B 39/02* | (2006.01) |
| *F28D 1/047* | (2006.01) |
| *F28D 1/053* | (2006.01) |

(52) U.S. Cl.
CPC ..... *F28B 9/08* (2013.01); *F28F 1/00* (2013.01); *F25B 39/028* (2013.01); *F25B 43/006* (2013.01); *F25B 2400/02* (2013.01); *F25B 2400/03* (2013.01); *F25B 2400/23* (2013.01); *F28D 1/0477* (2013.01); *F28D 1/05341* (2013.01)

(58) Field of Classification Search
CPC ..... F25B 2400/03; F25B 2400/23; F25B 2339/044; F25B 2339/0441; F25B 30/04; F25B 31/004; F25B 30/02; F28B 9/08; F28B 9/02; F28B 9/0243; F28B 9/0256; F28B 9/0273; F28B 9/0265; F28B 1/06; F28D 1/0477; F28D 1/05341; F28D 1/0475; F28D 2021/0061; F28F 2009/0285; F28F 1/00
USPC ..... 62/84, 194, 470, 473; 165/110
See application file for complete search history.

(56) References Cited

U.S. PATENT DOCUMENTS

| | | | | | |
|---|---|---|---|---|---|
| 2,163,591 | A | * | 6/1939 | Deverall | F25B 39/02 137/109 |
| 2,237,239 | A | | 4/1941 | Smith | |
| 2,566,170 | A | * | 8/1951 | Coons | F25B 17/06 62/144 |
| 2,614,648 | A | * | 10/1952 | Wilson | 95/158 |
| 2,867,098 | A | * | 1/1959 | Kocher | 62/473 |
| 2,938,712 | A | * | 5/1960 | Pellmyr | F28D 7/06 122/235.11 |
| 3,691,786 | A | * | 9/1972 | Anderson | F24F 13/22 62/279 |
| 3,828,567 | A | * | 8/1974 | Lesczynski | 62/160 |
| 4,472,949 | A | * | 9/1984 | Fujisawa et al. | 62/473 |
| 4,566,527 | A | * | 1/1986 | Pell et al. | 165/45 |
| 4,962,811 | A | * | 10/1990 | Yamamoto | F28D 1/0478 165/150 |
| 4,966,230 | A | * | 10/1990 | Hughes | F28D 1/035 165/150 |
| 5,005,285 | A | * | 4/1991 | Ishii | B23K 1/0012 228/198 |
| 5,551,507 | A | * | 9/1996 | Vogel | 165/82 |
| 5,782,293 | A | | 7/1998 | Sather | |
| 2003/0106292 | A1 | * | 6/2003 | Kitano et al. | 55/396 |
| 2006/0048929 | A1 | * | 3/2006 | Aaron et al. | 165/173 |
| 2007/0062214 | A1 | * | 3/2007 | Lyun-Su | 62/503 |
| 2008/0035077 | A1 | * | 2/2008 | Obayashi et al. | 122/13.01 |

FOREIGN PATENT DOCUMENTS

| | | | |
|---|---|---|---|
| JP | 05045022 | | 2/1993 |
| JP | 10 185361 | A | 7/1998 |
| JP | 10185361 | | 7/1998 |
| JP | 2010243108 | A * | 10/2010 |
| JP | 2010243108 | A | 10/2010 |

* cited by examiner

HEAT EXCHANGER FOR PHASE-CHANGING REFRIGERANT, WITH HORIZONTAL DISTRIBUTING AND COLLECTING TUBE

RELATED APPLICATIONS

This application is a continuation of PCT/EP2011/058421, filed on May 24, 2011, claiming priority from European Patent Application EP 101 649 93.7, filed on Jun. 4, 2010, both of which are incorporated in their entirety by this reference.

FIELD OF THE INVENTION

The invention relates to a multi channel heat exchanger for a refrigerant cycle. Heat exchangers of this type are used for example as condensers or evaporators in cooling- or heat pump cycles with a phase changing refrigerant.

BACKGROUND OF THE INVENTION

Multi channel heat exchangers essentially include a distributor which distributes the refrigerant over plural heat exchanger pipes, plural heat exchanger pipes in which the refrigerant is brought into indirect contact with the medium to be cooled or heated and a collector in which the refrigerant is collected from the plural heat exchanger pipes that are typically run in parallel before the refrigerant eventually leaves the heat exchanger.

In the art multi channel heat exchangers are typically configured with a vertical arrangement of the distributors and collectors with horizontally arranged heat transfer pipes arranged there between, wherein the distributors and collectors are typically configured segmented so that portions for collecting and distributing refrigerant are implemented in a vertical component.

For many applications, however, a horizontal arrangement of the heat exchangers is desirable for space reasons or other reasons, so that the known refrigerant collection and -distribution in the customary manner with vertically arranged collector- and distributor portions within a component is omitted due to the small available configuration height.

A heat exchanger in horizontal arrangement or position can be derived from e.g. DE 101 11 384 B4. Due to the dimensions of the heat exchanger it is suitable in particular for large cooling- or heating pump systems that are arranged on flat roofs or on the ground.

Furthermore EP 1 046 875 A2 discloses a multi channel heat exchanger with horizontal arrangement which includes a horizontally arranged distributor tube and a horizontally arranged collector tube.

It is a disadvantage of the recited embodiment that effective oil separation and an effective coolant collector function have to be taken over by additional components which makes using horizontal heat exchangers more difficult and more expensive.

BRIEF SUMMARY OF THE INVENTION

This yields the object to provide a heat exchanger which facilitates with lowest possible installation space and low installation height the refrigerant gas- or liquid distribution and oil separation before heat transfer in the heat exchanger tubes and refrigerant liquid or gas collection after heat transfer in the heat exchanger tubes with the option of phase separation of liquid and gaseous coolant phase.

According to the invention the object is achieved through a heat exchanger for a phase changing refrigerant including a horizontal distributor tube and a horizontal collector tube and a refrigerant carrying heat exchanger tubes connected there between, wherein the refrigerant inlet into the heat exchanger tubes is arranged in the upper portion of the cross section of the distributor tube and the coolant outlet from the heat exchanger tubes is arranged in the upper portion of the cross section of the collector tube for liquefaction operation of the multi channel heat exchanger so that oil separation is provided in the lower portion of the cross section of the distributor tube and refrigerant liquid separation is provided in the lower portion of the cross section of the collector tube.

According to the invention separating the liquid phase from the gas phase is implemented in the collector tube and also in the distributor tube through the arrangement of the means for extracting the phases in the respective portions of the horizontal collector- and distributor tubes. According to the invention the collection or distribution of the gaseous phase is respectively provided in the upper portion and the collection and distribution of the liquid phase is respectively provided in the lower portion of the cross section of the collector tube and the distributor tube.

Through the conceptional integration of these functions in the heat exchanger additional components for achieving these functions can be omitted in the respective refrigerant cycles. This saves space, installation space and cost during installations and operations of the coolant cycles configured with the heat exchanger according to the invention.

According to an advantageous embodiment of the invention, a horizontally arranged refrigerant gas- and oil filling spout are arranged at the distributor tube and a vertically arranged oil collector tube with oil return is arranged in the lower portion of the cross section of the distributor tube. During liquefaction operation the refrigerant gas/oil mix entering the distributor tube is separated, wherein the gaseous phase collects in the horizontal distributor tube in an upper portion and the liquid oil phase collects in the lower portion. The liquid oil phase is then extracted in the lower portion through the oil collector tube and the oil return, whereas the refrigerant vapor enters the heat exchanger tubes in the upper portion.

Advantageously the refrigerant gas inlet into the heat exchanger tube is configured in the upper portion of the cross section of the distributor tube through a gas inlet bend connected with the end of the heat exchanger tube. The gas inlet bend enters the distributor tube horizontally in the lower portion of the cross section of the distributor tube and eventually runs vertically upward forming a 90° bend. In the upper portion of the cross section of the distributor tube the gas inlet bend terminates with the opening for the refrigerant gas inlet. In order to optimize the separation effect and the flow mechanics the upper end of the gas inlet bend is configured slanted to form a maximum impact surface in flow direction of the refrigerant vapor for the refrigerant oil droplets.

According to an advantageous embodiment of the invention a vertically arranged liquid outlet spout for the liquid refrigerant phase is arranged in the lower portion of the cross section of the collector tube. The condensed liquid phase of the refrigerant collects density driven in the lower portion of the cross section of the collector tube and then runs out in downward direction through the liquid outlet spout.

Further advantageously the refrigerant liquid outlet from the heat exchanger tube is configured in the upper portion of the cross section of the collector tube through a liquid inlet bend. Thus, the horizontal heat transfer tube is connected with the horizontal end of the liquid inlet bend. The liquid inlet bend eventually runs to the collector tube forming a 90° bend in vertical downward direction and terminates with the opening for the refrigerant liquid inlet in the upper portion of the cross section of the collector tube.

The invention is advantageously implemented in that the ratio of the tube diameters of heat exchanger tubes to the distributor- or collector tubes is less than 0.7. Thus it is implemented that a sufficient volume is provided for the phase separation in the distributor tube and in the collector tube. According to an advantageous embodiment of the invention a ratio of 0.2-0.25 is considered optimum.

Additionally a connection for measuring instruments, sensors or similar is advantageously arranged at the collector tube.

The liquid outlet spout at the collector tube in the configuration of the heat exchanger as a condenser is preferably connected with a heat exchanger for super cooling the refrigerant liquid.

Alternatively the heat exchanger can be used as a flooded evaporator, wherein the horizontal distributor tube is in this case used as a collector and the horizontal collector tube is used as a distributor for the refrigerant.

BRIEF DESCRIPTION OF THE DRAWINGS

Further details, features and advantages of embodiments of the invention can be derived from the subsequent description with reference to the associated drawing figures, wherein.

DETAILED DESCRIPTION OF THE INVENTION

Figure 1:
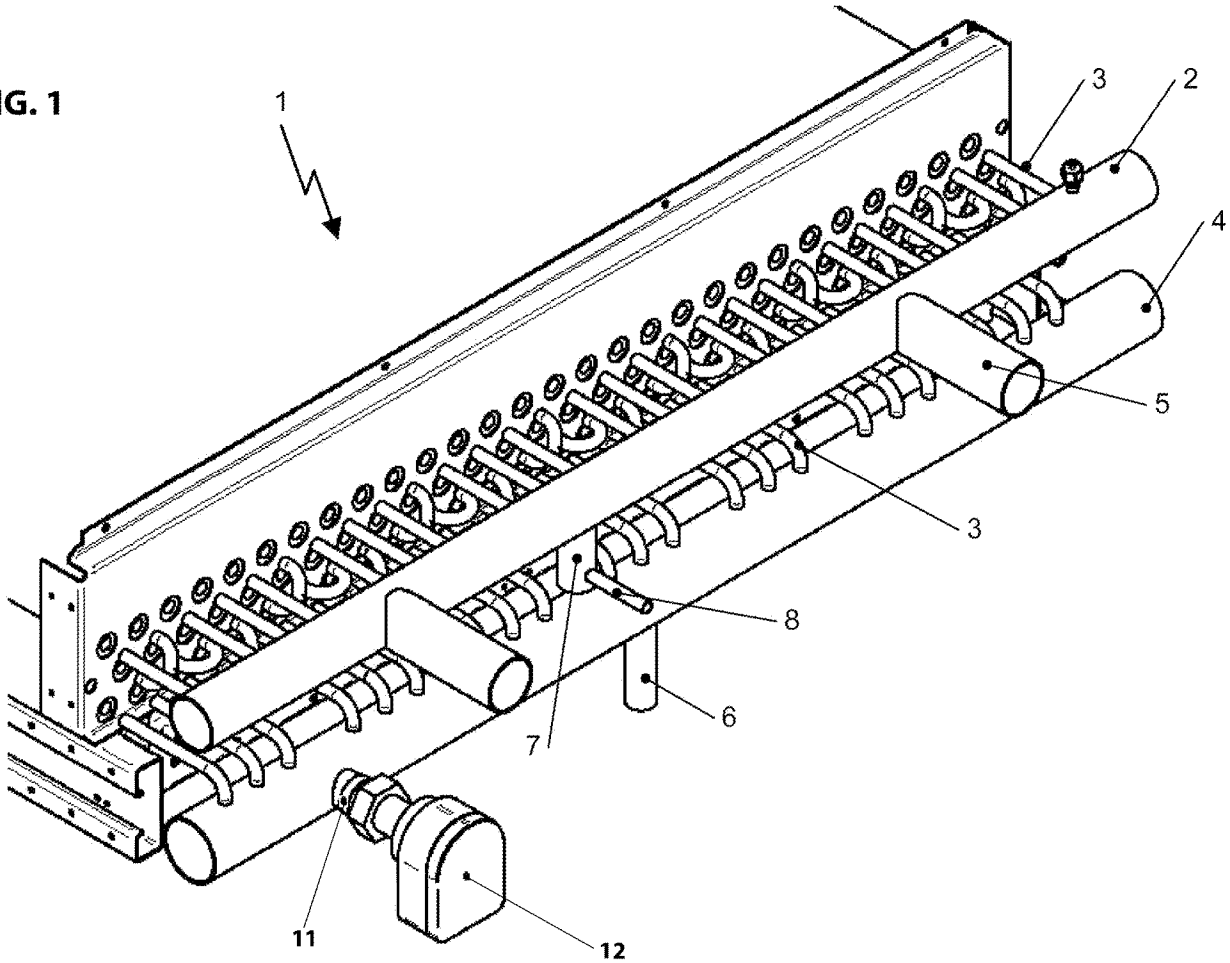
FIG. 1 illustrates a perspective view of a heat exchanger in a flat lying configuration with parallel horizontal refrigerant distributor- and collector tube.

FIG. 1 illustrates a heat exchanger 1 in a horizontal flat lying embodiment. A flat lying embodiment of the heat exchanger 1 means that the heat exchanger tubes 3 are connected horizontally in a plane with several channels at the horizontal distributor 2. Thus, the number of channels of the heat exchanger results from the number of heat exchanger tubes 3 exiting from the distributor tube 2. The heat exchanger tubes 3 run through the heat exchanger 1 in several planes in downward direction and are introduced in the lowest plane into the collector tube 4. The distributor tube 2 includes two gas- and oil inlet spouts 5 through which the refrigerant vapor-oil mix flows through the gas- and oil inlet spouts 5 into the distributor tube 2. In the distributor tube 2 the gas- and oil droplet mix is distributed horizontally, wherein a separation within the cross section of the distributor tube 2 is provided so that the refrigerant vapor deposits in the upper portion of the cross section and the liquid oil that has precipitated at the walls deposits in the lower portion of the cross section. The separated refrigerant oil moves through the oil collector tubes 7 exiting in vertically downward direction from the distributor tube 2 into an oil return 8 which adds the oil again to the refrigerant cycle at a suitable location in front of the compressor that is not illustrated.

The collector tube 4 forms the lowest point of the heat exchanger 1 for accumulating the refrigerant liquid and the heat exchanger tubes 3 run into the upper portion of the cross section of the collector tube 4, preferably at the highest point for accumulating the refrigerant vapor and other gases.

The refrigerant vapor that is condensed in the heat exchanger 1 functioning as a condenser reaches the upper portion of the collector tube 4 as a liquid refrigerant and a separation of the possibly still provided refrigerant vapor and of the refrigerant liquid is performed over the cross section of the volume of the collector tube 4, so that the condensed liquid refrigerant phase collects in the lower portion and the gaseous phase of the refrigerant remains in the upper portion of the collector tube 4, wherein the option of reverse gas extraction is provided in each particular heat exchanger pipe 3 exiting from the collector tube 4. Additionally a connection 11 for measuring instruments 12, sensors or similar is advantageously arranged at the collector tube.

It is a particular advantage of the illustrated embodiment of the invention that the phase separation of the refrigerant is not performed outside of the condenser which is different from other heat exchanger concepts.

This has the effect that the super cooling the refrigerant remains in the heat exchanger which has a positive effect upon the efficiency of the process. This causes a lower volume for the components. Furthermore the gas pass through during a pressure change due to a load change is effectively suppressed which in turn causes an increase of the efficiency of the refrigerant cycle.

Figure 2:
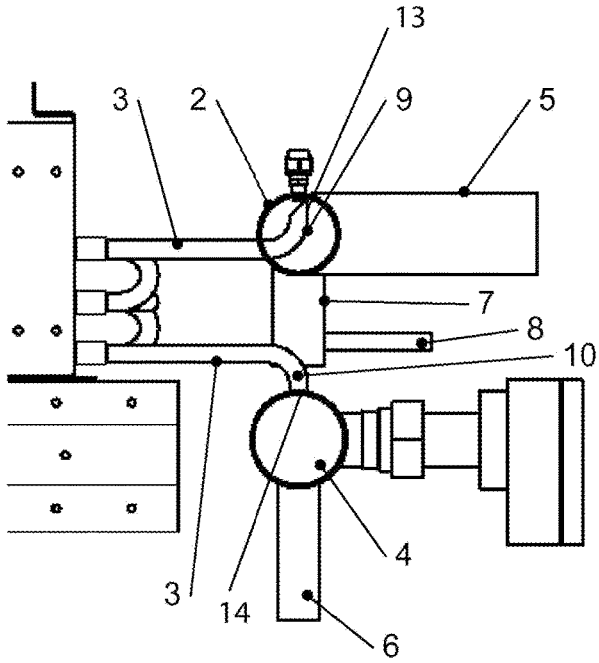
FIG. 2 illustrates a detail of a sectional view of the horizontal distributor tube and the horizontal collector tube and connections of the heat exchanger.

FIG. 2 illustrates configurative details. Through the gas and oil filing spout 5 the refrigerant gas- and oil mix is horizontally introduced into the distributor tube 2. It is illustrated in the cross section of the distributor tube according to the illustrated embodiment of the invention that the gas inlet bend 9 has a beveled opening for the refrigerant gas inlet 13 in the upper portion of the cross section of the distributor tube 2, extends vertically downward in the lateral bend into the lower portion of the distributor tube 2 and eventually penetrates the distributor tube in horizontal direction. The horizontal heat exchanger tubes 3 are connected with the horizontal ends of the gas inlet bends 9. The refrigerant gas moves through the gas inlet in the upper portion of the cross section of the distributor tube 2 into the gas inlet bend 9 and through the gas inlet bend into the heat exchanger tubes 3.

Multiple deflections of the flow direction of the refrigerant gas provide a separation of refrigerant oil droplets which were pulled along and which precipitate at the walls of the distributor tube 2 and of the gas inlet bends 9 and flow downward following the contours of the distributor tube 2 and collect in the lower portion of the distributor tube 2.

It is particularly advantageous in this embodiment with the gas inlet bends 9 that due to multiple flow direction changes the dynamic pressure of the refrigerant gas flow from the gas and oil filing spout 5 does not impact the heat exchanger tubes 3 and thus substantially reduces or completely excludes oil droplets from being pulled along by the refrigerant gas flow. It is another advantage of the invention that the configuratively improved distribution of the gas flow and the substantial prevention of the short circuit flows provides a more even surface loading of the heat exchanger 1. This means that the refrigerant gas flow is more evenly distributed over the heat exchanger tubes 3 which reduces the temperature differences in the heat exchanger and thus increases its efficiency.

Eventually the refrigerant oil is drained from the distributor tube 2 through the oil collector tube 7 and is routed back into the refrigerant cycle through an oil return 8 at a suitable location.

The refrigerant gas which eventually moves into the heat exchanger tubes 3 through the gas inlet bends 9 from the distributor tube 2 is now brought into indirect thermal contact with the cooling air flow and liquefied on the path through the heat exchanger 1 in downward direction. The outlet 14 of the liquefied refrigerant from the heat exchanger tube 3 is provided according to FIG. 2 through a liquid inlet bend 10 which leads into the upper portion of the collector tube 4. In the illustrated embodiment the end of the liquid inlet bend 10 is directly connected with the upper apex point of the collector tube 4 and for example soldered or welded into the collector tube 4. The refrigerant liquid thus flows in the upper portion into the circular space in the collector tube 4, wherein vapor components of the refrigerant are separated from the mass flow and collect in the upper portion of the collector tube 4. The refrigerant vapor in the collector tube 4 is thus capable to flow back in upward direction into the heat exchanger tubes 3 driven by its low density and subsequently condenses further.

The collector tube 4 includes a connector configured as liquid outlet spout 6 through which the condensate leaves the heat exchanger 1. An advantageous embodiment of the invention is not illustrated according to which a super cooler is connected to the liquid outlet spout 6 in which the condensed refrigerant is additionally super cooled for improving the efficient of the refrigerant cycle.

It is particularly advantageous in this embodiment of the invention that refrigerant vapor- and oil separation in the distributor tube 2 is performed in a particularly efficient manner through the additional surfaces of the outer jacket of the gas inlet bend 9 and thus only very little refrigerant oil reaches the heat exchanger tubes 3 since the oil is precipitated to a high degree in the distributor tube 2 and run out through the oil collector tube 7 and the oil return 8.

Through the rather large configuration of the distributor tube 2 and of the collector tube 4 the heat exchanger 1 can perform the function of the refrigerant collector, in particular through the volume of the collector tube 4 in a refrigerant cycle and the additional component of the collector within the refrigerant cycle can be omitted in its entirety. It is a particular advantage of the invention that the refrigerant filling volume can be reduced by 40-50% through this configuration.

Figure 3:
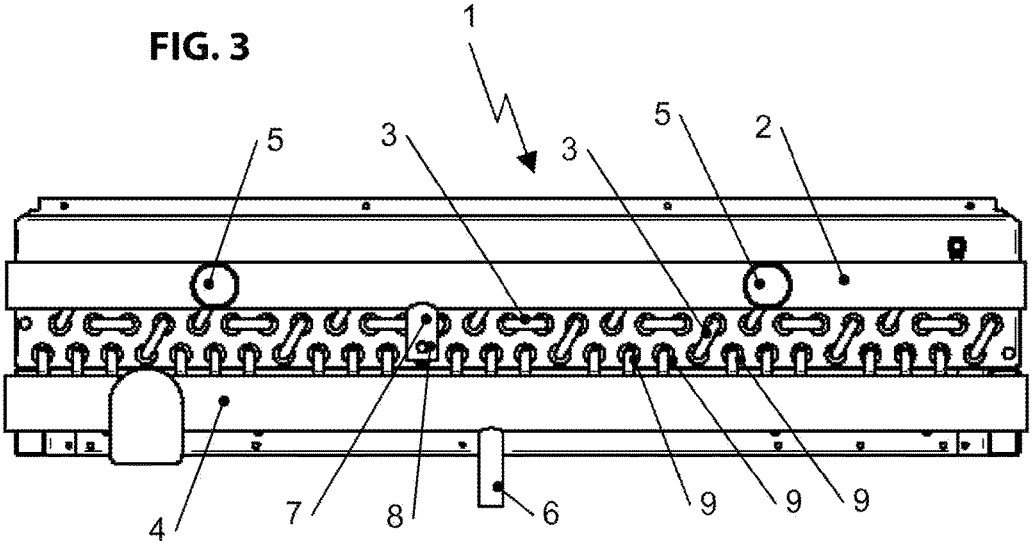
FIG. 3 illustrates a front view of the heat exchanger.

FIG. 3 illustrates a front view of a heat exchanger 1. The distributor tube 2 and the two gas- and oil filling spouts 5 form the upper horizontal position of the heat exchanger 1. The oil collector tube 7 and the oil return 8 are approximately centrally arranged and let the separated refrigerant oil out. Below the distributor tube 2 the levels of the heat exchanger tubes 3 are visible which are connected with one another through bends. The lowest level of the heat exchanger tubes 3 exits the drawing plane horizontally and is run out in vertical downward direction through the gas inlet bends 9. The gas inlet bends 9 lead into the uppermost point of the collector tube 4 so that the condensed refrigerant runs in downward direction into the collector and exits the heat exchanger 1 through the liquid outlet spout 6. In this perspective the compact configuration of the heat exchanger 1 is clearly visible and it is illustrated in particular that no additional installation space is required through the functional integration of oil collector and refrigerant collector in the heat exchanger.

It is particularly advantageous that the heat exchanger 1 can also be used as a flooded evaporator for example in a heat pump cycle. Thus, the distributor tube 2 forms the collector for the refrigerant gas from the evaporator and the collector tube 4 is the distributor for the refrigerant liquid in the functionally reversed heat exchanger 1 that is operating as a flooded evaporator.

Since refrigerant cycles of this type are operable with the heat exchanger without collector this yields numerous advantages. For example the refrigerant filling volumes in these cycles can be reduced through functional integration of the collector into the condenser which in addition to an ecologically and economically favorable minimization of the refrigerant filling amounts for the refrigerant cycle leads to a reduction of the size of refrigeration systems of this type and thus reduces cost during installation and implementation of such cycles.

It is particularly advantageous in a cycle of this type that undesirable oil propagation can be countered through integration of oil propagation into the distributor tube 2.

Another advantage of the implementation of the invention is that also an efficient reverse gas extraction is feasible in each particular heat exchanger pipe 3. Thus, complex measures for securing gas extraction within a refrigerant cycle are not required which leads to further cost reduction.

The concept of the invention is applicable for various heat exchanger tasks; a particularly important application of the invention is the configuration of the heat exchangers 1 as air cooled condenser.

As stated supra additional applications include using the heat exchanger 1 as flooded evaporator, for example for heat pump systems.

It is furthermore advantageous that connecting plural heat exchangers according to the invention in parallel is possible without the problems of uneven surface loading and temperature layering that is known in the art.

Advantageous applications for the heat exchangers 1 in refrigerant cycles are in the field of stationery refrigeration in particular for cooling super markets.

REFERENCE NUMERALS AND DESIGNATIONS

1 heat exchanger
2 distributor tube
3 heat exchanger tube
4 collector tube
5 gas and oil inlet spout
6 liquid outlet spout
7 oil collector tube
8 oil return
9 gas inlet bend
10 liquid inlet bend
11 connection for instrument
12 instrument
13 refrigerant gas inlet
14 refrigerant outlet

What is claimed is:

1. A heat multi channel exchanger for a phase changing refrigerant and an oil, comprising:

a horizontal distributor tube including the phase changing refrigerant and the oil;

a horizontal collector tube including the phase changing refrigerant; and at least one refrigerant carrying heat exchanger tube connected there between, wherein a vertically arranged oil collector tube with an oil return is arranged in a lower half of the horizontal distributor tube, wherein refrigerant vapor of the phase changing refrigerant enters the at least one heat exchanger tube in an upper half of the horizontal distributor tube, wherein refrigerant vapor of the phase changing refrigerant in the at least one heat exchanger tube condenses into a liquid phase, wherein the phase changing refrigerant exits the at least one heat exchanger tube through a refrigerant outlet in an upper half of the horizontal collector tube, wherein the oil is separated from the phase changing refrigerant in a lower half of the horizontal distributor tube, wherein liquid refrigerant is separated from the phase changing refrigerant in the lower half of the horizontal collector tube, wherein the refrigerant gas inlet into the at least one heat exchanger tube is arranged in the upper half of the horizontal distributor tube and is connected through a gas inlet bend with an end of the at least one heat exchanger tube, and wherein the gas inlet bend horizontally enters the horizontal distributor tube in the lower half of the horizontal distributor tube and extends as the bend in vertical upward direction and terminates in the upper half of the horizontal distributor tube with an opening for the refrigerant gas inlet.

2. The multi channel heat exchanger according to claim 1, wherein a horizontally arranged refrigerant gas and oil inlet spout is arranged at the horizontal distributor tube.

3. The multi channel heat exchanger according to claim 1, wherein a vertically arranged liquid outlet spout is provided in the lower half of the horizontal collector tube.

4. The multi channel heat exchanger according to claim 1, wherein the refrigerant liquid outlet from the at least one heat exchanger tube is arranged in the upper half of the horizontal collector tube through a liquid inlet bend connected with an end of the at least one heat exchanger tube, and wherein the liquid inlet bend terminates in the upper half of the horizontal collector tube with an opening for a refrigerant liquid inlet into the horizontal collector tube.

5. The multi channel heat exchanger according to claim 1, wherein a connection for a measuring instrument or a sensor is provided at the horizontal collector tube.

6. The multi channel heat exchanger according to claim 1, wherein a liquid outlet spout is connected with a heat exchanger that super cools the refrigerant liquid.

7. The multi channel heat exchanger according to claim 1, wherein the horizontal distributor tube defines a longitudinal axis.

8. The multi channel heat exchanger according to claim 7, wherein the horizontal collector tube is parallel to the longitudinal axis.

9. The multi channel heat exchanger according to claim 1, wherein the horizontal collector tube define a longitudinal axis.

10. The multi channel heat exchanger according to claim 1, wherein at least part of the at least one heat exchanger tube is oriented horizontally.

* * * * *